US005151943A

United States Patent [19]

Van Gelder

[11] Patent Number: 5,151,943

[45] Date of Patent: Sep. 29, 1992

[54] LOW DISTORTION DYNAMIC LOUDSPEAKER

[75] Inventor: Carl Van Gelder, Tioga Center, N.Y.

[73] Assignee: McIntosh Laboratory, Inc., Binghamton, N.Y.

[21] Appl. No.: 611,552

[22] Filed: Nov. 13, 1990

[51] Int. Cl.[5] ..... H04R 25/00

[52] U.S. Cl. ..... 381/189; 381/197; 381/199

[58] Field of Search ..... 381/150, 153, 156, 189, 381/192, 193, 194, 197, 199, 200

[56] References Cited

U.S. PATENT DOCUMENTS

| | | | |
|---|---|---|---|
| 4,399,334 | 8/1983 | Kakiuchi et al. | 381/189 |
| 4,414,437 | 11/1983 | Trauernicht et al. | 381/197 |
| 4,531,025 | 7/1985 | Danley et al. | 381/199 |
| 4,547,632 | 10/1985 | Bryson | 381/194 |
| 4,661,973 | 4/1987 | Takahashi | 381/194 |

FOREIGN PATENT DOCUMENTS

| | | | |
|---|---|---|---|
| 2842999 | 4/1980 | Fed. Rep. of Germany | 381/197 |
| 0010796 | 2/1981 | Japan | 381/189 |
| 0060899 | 4/1983 | Japan | 381/197 |

*Primary Examiner*—Curtis Kuntz
*Assistant Examiner*—William Cumming
*Attorney, Agent, or Firm*—Salzman & Levy

[57] ABSTRACT

The present invention features a dynamic speaker having improved output power and decreased second harmonic distortion. The reduction in second harmonic distortion results from a sandwich-type shielding arranged about the stepped pole piece of the speaker. The shielding protects the voice coil from a non-symmetrical magnetic flux interaction with the air gap between the pole piece and the front plate. This reduces the second harmonic distortion due to the non-symmetry of the minor hysteresis loop formed by the magnetic field of the energized voice coil with the static magnetic field acting on the ferromagnetic material making up the pole piece. Additionally, the decrease in inductance due to the location of the nonferromagnetic shielding members produces an increase in output.

14 Claims, 5 Drawing Sheets

LOW DISTORTION DYNAMIC LOUDSPEAKER

FIELD OF THE INVENTION

The invention pertains to dynamic loudspeakers and, more particularly, to a dynamic loudspeaker having an increased power output with reduced harmonic distortion.

BACKGROUND OF THE INVENTION

Present day construction of dynamic loudspeakers features a vibrating cone disposed in front of a pole piece with surrounding voice coil. The voice coil is disposed in a magnetic air gap between the pole piece and a front plate. When an audio signal is fed to the voice coil, the voice coil is caused to reciprocate axially within the magnetic air gap about the pole piece.

The non-symmetric magnetic flux interactions in the magnetic air gap during the operation of the loudspeaker have been found to rob the dynamic loudspeaker of output power, as well as to introduce harmonic distortion.

The present invention seeks to shield the voice coil from non-symmetrical magnetic flux interactions produced in the magnetic air gap between the pole piece and the front plate.

Dynamic loudspeakers require a linear magnetic field to reproduce sound with minimum distortion. This requirement becomes most difficult at low frequencies and at high power levels, where there is large amplitude cone and voice coil movement. Improved performance can be achieved by fabricating the pole piece with a stepped configuration, i.e., a pole piece having first and second integral cylindrical sections with an upper cylindrical section having a wider diameter.

In spite of employing stepped pole pieces, the second harmonic distortion has been difficult to eliminate. It is created by the non-symmetric interaction between the magnetic field generated by the voice coil and another magnetic field generated across the air gap through the front plate and the pole piece. This other magnetic field results from a ceramic magnet disposed adjacent the front plate and the pole piece.

Shielding techniques have been employed by others with various success. These prior art shielding methods utilize copper plated pole pieces, or the placement of a copper cylinder through the air gap. Copper plated pole pieces provide only a thin layer of shielding, which is not very effective. Placement of a copper cylinder in the air gap creates a wider air gap, which in turn reduces the power output of the speaker. Another speaker construction has introduced a flux-stabilizing ring located away from the air gap/pole tip and around the pole piece adjacent to the back plate. This ring is claimed to maintain a constraint level of magnetic energy in the voice coil gap.

The present invention has improved the output power and lowered the second harmonic distortion of the speaker by placing two highly conductive, nonferromagnetic members adjacent the magnetic air gap on opposite sides of the wider section of the stepped pole piece. These highly conductive, nonferromagnetic members, in addition to the careful selection of other structural members of the speaker, produces a twelve inch woofer with increased output and low distortion, particularly low distortion in the second harmonic.

The highly conductive, nonferromagnetic members used in the construction of the invention substantially shield the stepped pole piece in the vicinity of the air gap from a non-symmetrical interaction with the magnetic field generated by the voice coil. The sandwich arrangement employed by the invention also effectively reduces voice coil inductance, thereby improving the power output while simultaneously increasing inductance symmetry, thereby reducing non-symmetric distortion. This in turn decreases the audible distortion, especially the second harmonic.

SUMMARY OF THE INVENTION

In accordance with the present invention, there is provided a dynamic loudspeaker distinguished by increased power output with decreased distortion. The dynamic loudspeaker has a cone movably supported within a basket, that is in turn supported upon a front plate. A back plate is disposed behind the front plate. An annular magnet is disposed between the front plate and the back plate. A cylindrical stepped pole piece is disposed within the annular magnet and supported by the back plate. The pole piece forms an air gap with the front plate, across which a magnetic flux is created. A voice coil is disposed within the air gap between the pole piece and the front plate. A pair of first and second highly conductive, nonferromagnetic shield members are each disposed adjacent the pole piece. The first shield member is disposed atop the pole piece, and the second shield member is disposed on the underside of the pole piece. The first and second shield members shield the voice coil from non-symmetrical magnetic flux interactions created in the air gap, whereby the dynamic loudspeaker has increased power output with decreased distortion.

BRIEF DESCRIPTION OF THE DRAWINGS

A complete understanding of the present invention may be obtained by reference to the accompanying drawings, when taken in conjunction with the detailed description thereof and in which.

DESCRIPTION OF THE PREFERRED EMBODIMENT

Generally speaking, the invention features a dynamic loudspeaker having improved power output with reduced second harmonic distortion. The improvement in the operating characteristics of the speaker of this invention results from two shielding members that surround and protect the pole piece of the speaker. The harmonic distortion of the inventive loudspeaker has been reduced by more than ten decibels over the two octave band between 50 Hz and 200 Hz.

Figure 3:
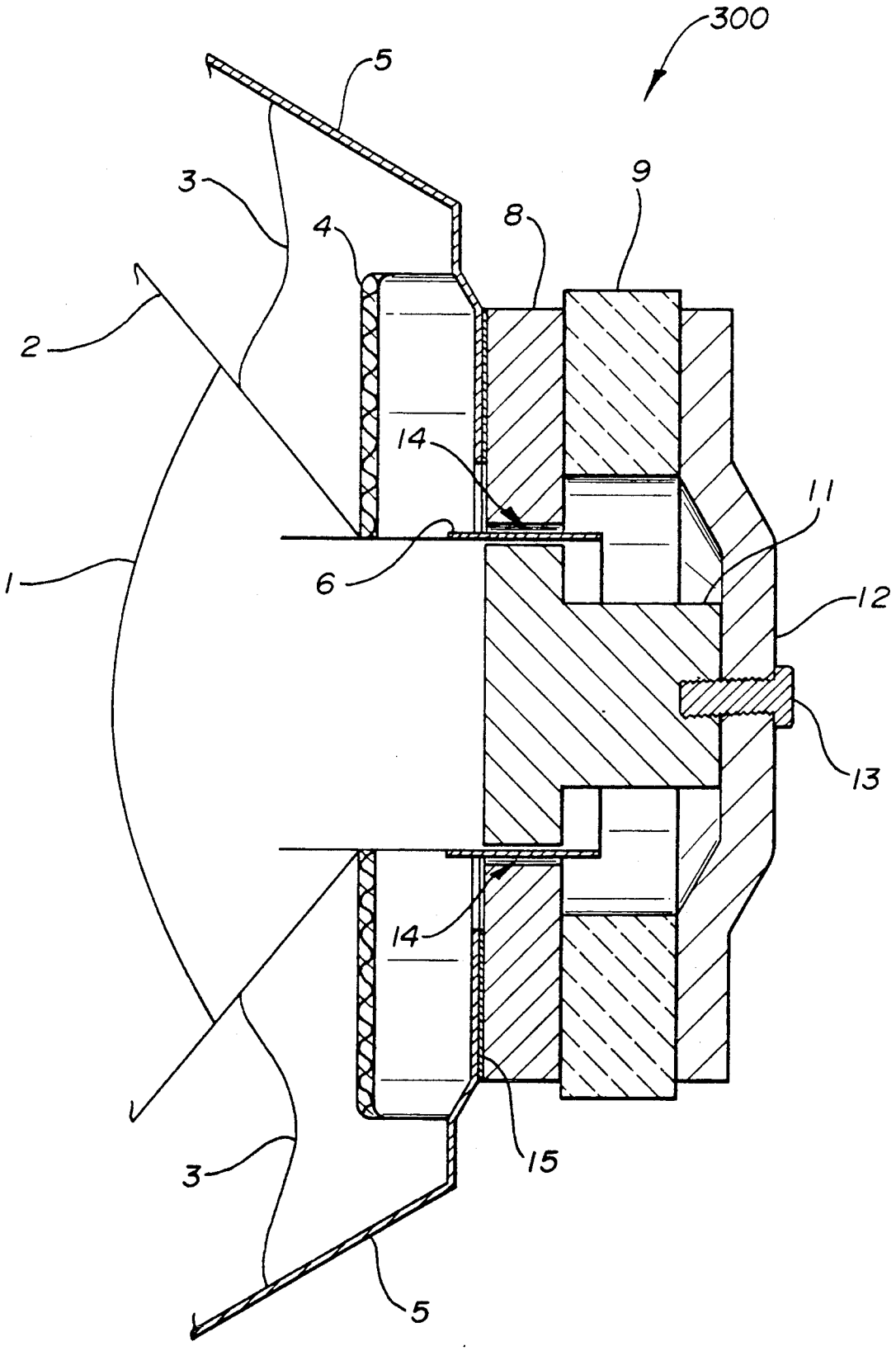
FIG-3 PRIOR ART
FIG. 3 depicts a cross-sectional view of a prior art dynamic loudspeaker without the benefit of the sandwich-type shielding members of this invention.

Now referring to FIG. 3, a prior art loudspeaker 300 is illustrated. The speaker consists of a felt dust cap 1 attached to a paper cone 2. Multi-stranded tinsel leads 3 are affixed to cone 2 and to insulated terminals (not shown) on the twelve inch steel basket 5.

A split aluminum bobbin voice coil 6 is disposed in an air gap 14 between a stepped pole piece 11 and a one-half inch steel front plate 8.

A phenolic impregnated cloth spider 4 is disposed between basket 5 and the base of cone 2. An annular ceramic magnet 9 surrounds the central pole piece 11, and is disposed between the front plate 8 and a back plate 12 made of three-eighths inch steel. A bolt 13 affixes the pole piece 11 to the back plate 12. A paper, anti-buzz washer is disposed between the bottom of basket 5 and the top of the front plate 8, as shown.

The careful selection of the above components of the prior art speaker provides a twelve inch woofer with low distortion, and in particular a speaker with low third order harmonics.

Figure 4:
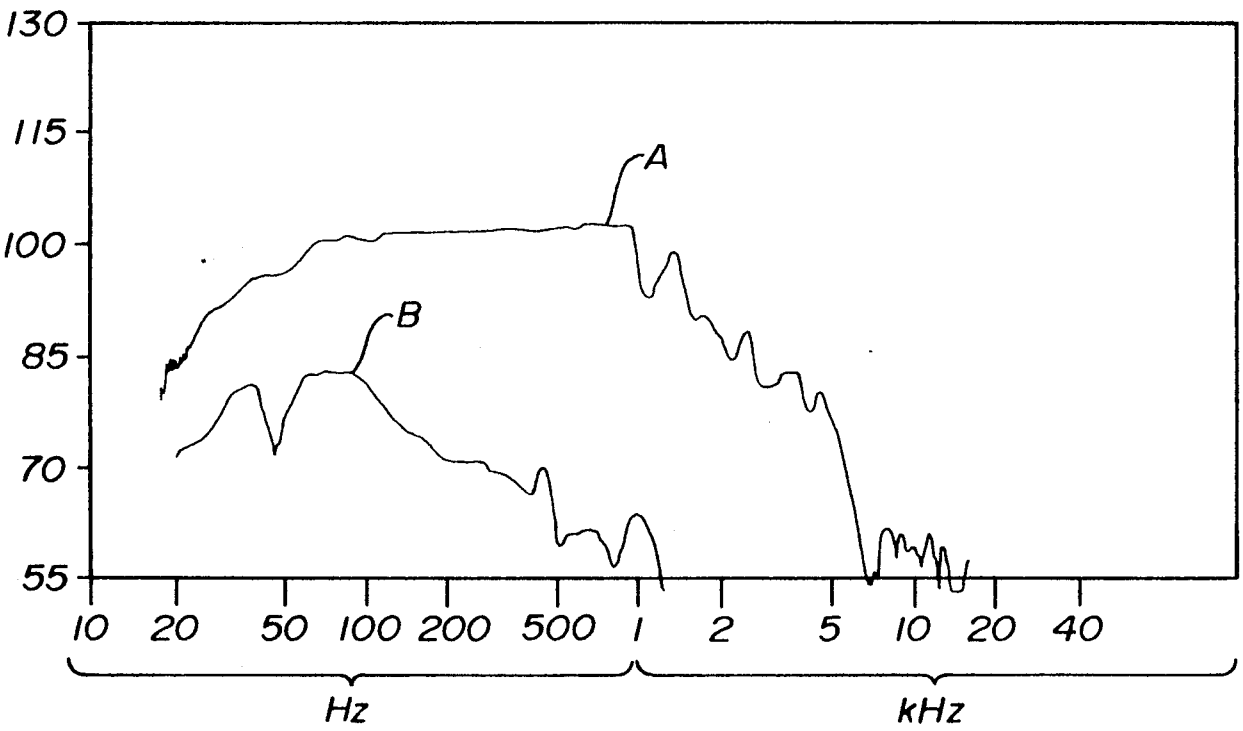
FIG-4 PRIOR ART
FIG. 4 is a graph illustrating the power output and distortion characteristics of a dynamic loudspeaker constructed similarly to the speaker shown in FIG. 3, without the magnetic flux shielding of this invention.

Such a speaker design has a "lower than average" level of second order harmonics, as depicted by the graph shown in FIG. 4. This graph depicts the general output power A slightly above the 101.5 decibel level, and the second order harmonic output B reaching the 84 decibel level at 80 Hz. This represents about 13% second harmonic distortion.

In order to improve the second order harmonics of the above speaker design, the invention has developed sandwich-type shielding. In the first embodiment of the invention, depicted in FIG. 1, the speaker 100 has been fitted with two aluminum shielding pieces consisting of a disc 7 and a ring 10. The ring 10 fits around the pole piece under the wider stepped portion 16, adjacent the air gap 14. The aluminum disc 7 fits on the top surface 17 of the stepped portion 16, as illustrated. The disc 7 and ring 10 sandwich the pole piece, and effectively shield the stem of the pole piece 11 from the magnetic field generated by the voice coil 6. The sandwich shielding reduces inductance, thereby increasing loudspeaker power output, while reducing non-symmetric distortion. This in turn decreases the audible distortion, especially with respect to the second order harmonics.

One of the advantages of the above sandwich-type shielding arrangement of this invention is the ability to place a large volume of shielding material about the pole piece. The front plate can be sandwiched by appropriate nonferromagnetic and electrically conductive material similar to the stepped pole piece to obtain lower distortion instead of or in addition to the preferred embodiment described herein. Such large volume shielding reduces the need for shielding materials within the air gap, with the resulting loss of output power.

Figure 1:
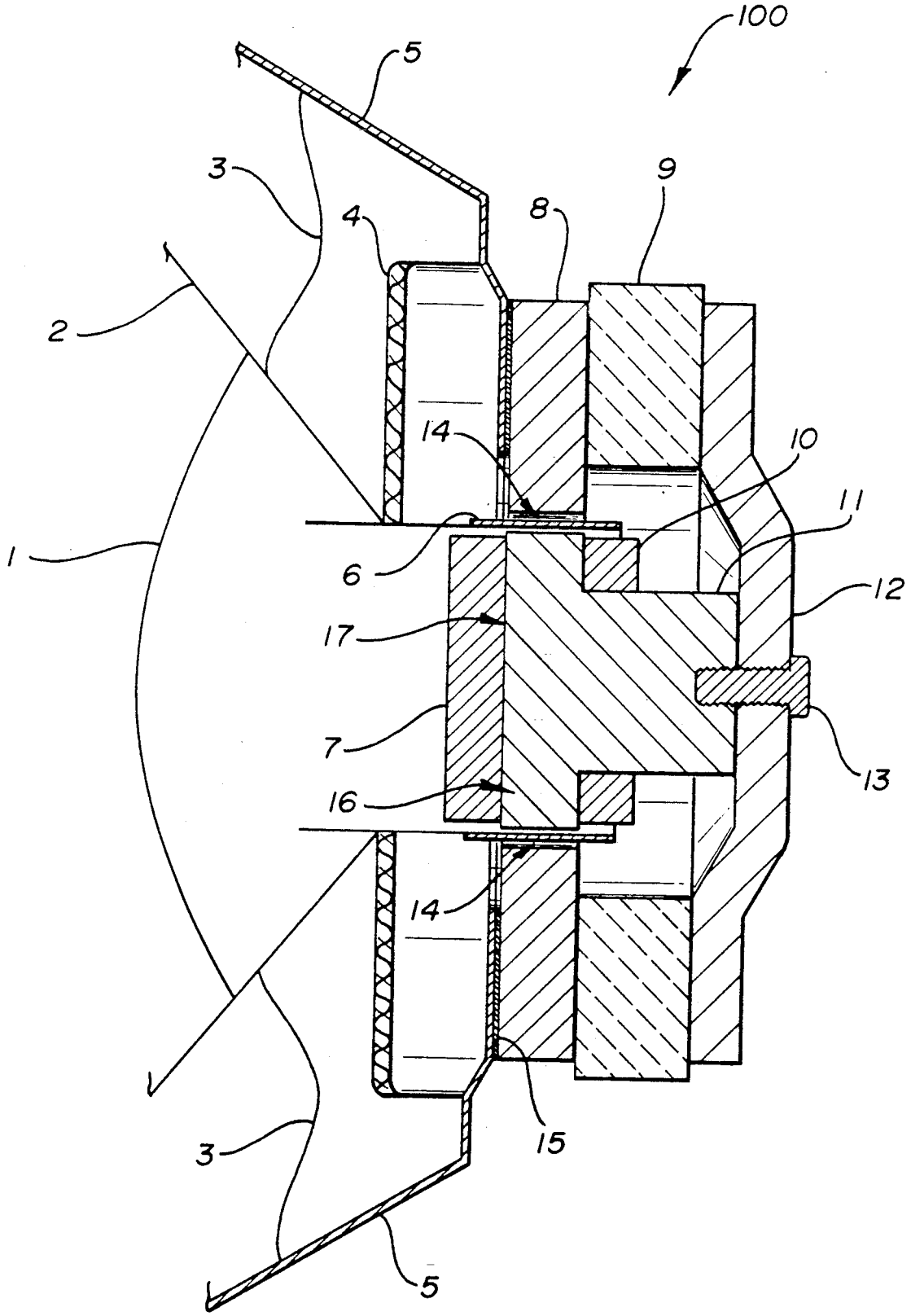
FIG. 1 is a cross-sectional view of one embodiment of the dynamic loudspeaker of this invention.
Figure 2:
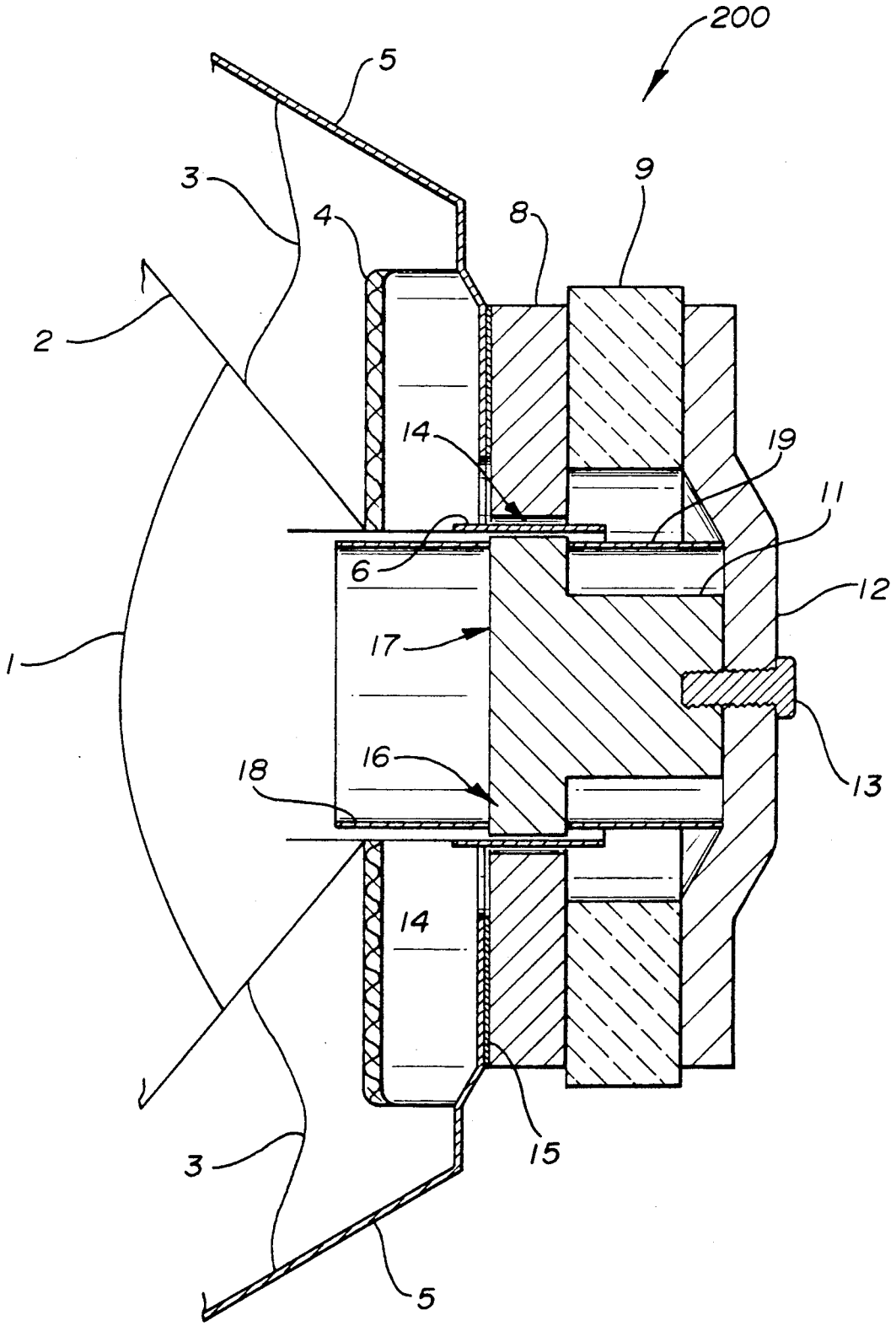
FIG. 2 is a cross-sectional view of a second embodiment of the dynamic loudspeaker of the invention.

Referring to FIG. 2, an alternate embodiment of the speaker 100 with sandwich-type shielding elements 7 and 10 of FIG. 1, is illustrated. FIG. 2 depicts a speaker 200 that replaces disc and ring components 7 and 10 with two copper tubes 18 and 19, respectively. The copper tube 18 is disposed on the top 17 of pole piece 11, and is designed to replace the disc 7, while the copper tube 19 is disposed below the stepped portion 16 of pole piece 11, and is designed to replace the ring 10. Both the copper tubes 18 and 19 effectively sandwich the pole piece 11 in similar manner to the embodiment of FIG. 1.

Figure 5:
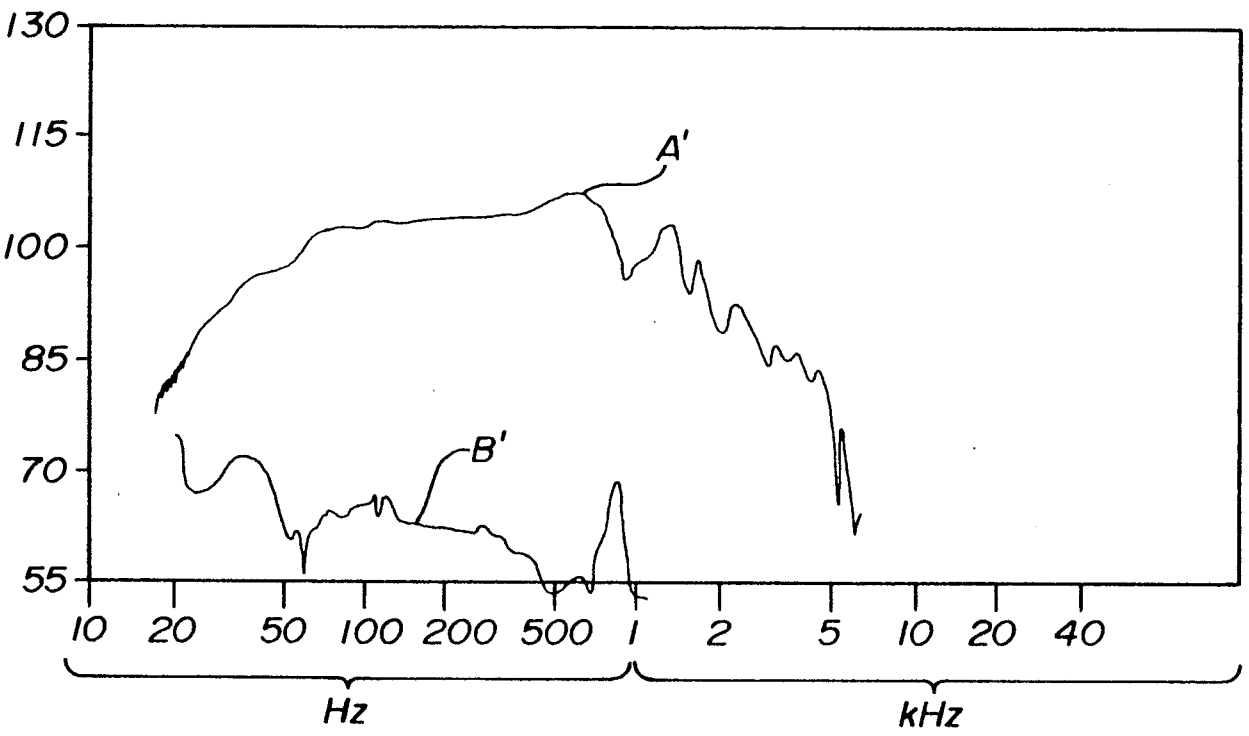
FIG. 5 is a graph illustrating the power output and distortion characteristics of a dynamic loudspeaker constructed similarly to the speaker shown in FIG. 2, with the sandwich-type, magnetic flux shielding of this invention.

The two embodiments of FIGS. 1 and 2 improve the power output and reduce second harmonic distortion, as illustrated in FIG. 5. The upper curve A' shows a power output approaching 103.5 decibels, and a second harmonic output B' of below 65 decibels. This represents a second harmonic distortion of about 1.2%.

In the current example, the air gap 14 is characterized as a 5.5 kilogauss cylindrical air gap, but the invention is not limited to this value and speakers with a different air gap flux level are feasible.

The dimensions of any of the parts, and particularly the sandwich-type shielding members 7 and 10, respectively, can vary with the change of design of the speaker 100. Likewise, the elements 18 and 19 can also change in size with changes in the speaker design. Any nonferromagnetic and electrically conductive material can be used for the shielding members including aluminum and copper, but not limited thereto.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented by the subsequently appended claims.

What is claimed is:

1. A dynamic loudspeaker distinguished by increased power output with decreased distortion, said dynamic loudspeaker having a cone movably supported within a basket, said basket supported upon a front plate, a back plate disposed behind said front plate, an annular magnet disposed between said front plate and said back plate, a cylindrical stepped pole piece disposed within said annular magnet and supported by said back plate, said cylindrical stepped pole piece comprising a first cylinder disposed adjacent said back plate, and a second, wider cylinder integrally disposed upon said first cylinder, the outer surface of said second, wider cylinder forming an air gap with said front plate, across which a magnetic flux is created, a voice coil disposed within said air gap between said cylindrical stepped pole piece and said front plate, and first and second, spaced-apart shield members, each comprising tube-like members, each of which is disposed adjacent said cylindrical stepped pole piece on distal sides thereof, said first shield member disposed between said cylindrical stepped pole piece and said cone, and said second shield member disposed between said cylindrical stepped pole piece and said annular magnet, said first and second shield members shielding said cylindrical stepped pole piece from magnetic flux interactions created in said air gap and reducing non-symmetrical voice coil inductances, whereby said dynamic loudspeaker has increased power output with decreased distortion.

2. The dynamic loudspeaker in accordance with claim 1, wherein said first and second tube-like members each comprise highly conductive nonferromagnetic material.

3. The dynamic loudspeaker in accordance with claim 1, wherein said first and second shield members each comprise highly conductive nonferromagnetic material.

4. The dynamic loudspeaker in accordance with claim 1, wherein said first and second tube-like members each comprise copper.

5. The dynamic loudspeaker in accordance with claim 1, wherein said first and second shield members each comprise copper.

6. A dynamic loudspeaker distinguished by increased power output with decreased distortion, said dynamic loudspeaker having a cone movably supported within a basket, said basket supported upon a front plate, a back plate disposed behind said front plate, an annular magnet disposed between said front plate and said back plate, a cylindrical pole piece having first and second cylindrical sections forming stepped cylinders, respectively, said first cylindrical section of said pole piece disposed within said annular magnet and supported by said back plate, said second cylindrical section of said pole piece forming an air gap with said front plate across which a magnetic flux is created, a voice coil disposed within said air gap between said pole piece and said front plate, and first and second, spaced-apart tube-like members each of which is disposed adjacent said pole piece, said first tube-like member disposed between said second cylindrical section of said pole piece and said cone, and said second tube-like member disposed between said first cylindrical section of said pole piece and said annular magnet, said first and second tube-like members being spaced apart from each other on distal sides of said first cylindrical section of said cylindrical pole piece adjacent said air gap, said first and second tube-like members shielding said pole piece from magnetic flux interactions created in said air gap, whereby said dynamic loudspeaker has increased power output with decreased distortion.

7. The dynamic loudspeaker in accordance with claim 6, wherein said first and second tube-like members each comprise highly conductive nonferromagnetic material.

8. The dynamic loudspeaker in accordance with claim 6, wherein said first and second tube-like members each comprise highly conductive nonferromagnetic material.

9. The dynamic loudspeaker in accordance with claim 7, wherein said first and second tube-like members each comprise copper.

10. The dynamic loudspeaker in accordance with claim 6, wherein said first and second tube-like members each comprise copper.

11. A dynamic loudspeaker distinguished by increased power output with decreased distortion, said dynamic loudspeaker having a cone movable supported within a basket, said basket supported upon a front plate, a back plate disposed behind said front plate, an annular magnet disposed between said front plate and said back plate, a cylindrical stepped pole piece disposed within said annular magnet and supported by said back plate, said cylindrical stepped pole piece comprising a first cylinder disposed adjacent said back plate, and a second, wider cylinder integrally disposed upon said first cylinder, the outer surface of said second, wider cylinder forming an air gap with said front plate across which a magnetic flux is created, a voice coil disposed within said air gap between said pole piece and said front plate, and first and second, spaced-apart magnetic flux-shielding members each of which is disposed adjacent said pole piece, said first magnetic flux-shielding member disposed between said pole piece and said cone, and said second magnetic flux-shielding member disposed between said pole piece and said annular magnet, said first and second magnetic flux-shielding members being spaced apart from each other on distal sides of said second, wider cylinder of said cylindrical pole piece adjacent said air gap, and each comprising highly conductive non-ferromagnetic material, said first and second magnetic flux-shielding members reducing the magnetic flux interactions created in said air gap, whereby said dynamic loudspeaker has increased power output with decreased distortion.

12. The dynamic loudspeaker in accordance with claim 11, wherein said first and second magnetic flux-shielding members each comprise aluminum.

13. The dynamic loudspeaker in accordance with claim 11, wherein said first magnetic flux-shielding member comprises a substantially solid disc, and said second magnetic flux-shielding member comprises a ring member.

14. The dynamic loudspeaker in accordance with claim 11, wherein each of said first and second magnetic flux-shielding members comprise a hollow cylinder.

* * * * *